US010285462B2

(12) United States Patent
Charles

(10) Patent No.: US 10,285,462 B2
(45) Date of Patent: May 14, 2019

(54) HEAT PROVIDING FOOTBALL GLOVE

(71) Applicant: Jamaal Charles, Laguna Hills, CA (US)

(72) Inventor: Jamaal Charles, Laguna Hills, CA (US)

( * ) Notice: Subject to any disclaimer, the term of this patent is extended or adjusted under 35 U.S.C. 154(b) by 273 days.

(21) Appl. No.: 15/073,934

(22) Filed: Mar. 18, 2016

(65) Prior Publication Data

US 2016/0287970 A1 Oct. 6, 2016

Related U.S. Application Data

(60) Provisional application No. 62/140,021, filed on Mar. 30, 2015.

(51) Int. Cl.

*A41D 19/00* (2006.01)
*A63B 71/14* (2006.01)
*A41D 19/015* (2006.01)

(52) U.S. Cl.

CPC ..... *A41D 19/01535* (2013.01); *A41D 19/002* (2013.01); *A63B 71/141* (2013.01); *A41D 19/0037* (2013.01); *A63B 2209/10* (2013.01); *A63B 2225/64* (2013.01); *A63B 2243/0025* (2013.01)

(58) Field of Classification Search

CPC ..... A63B 71/141; A63B 2243/0025; A63B 2225/64; A63B 2209/10; A41D 19/01535; A41D 19/002; A41D 19/0037; A41D 13/0051; A41D 19/0024; A41D 2400/10

USPC ..... 2/159, 160, 164, 247, 250, 917

See application file for complete search history.

(56) References Cited

U.S. PATENT DOCUMENTS 1,154,122 A * 9/1915 Kovesy ..... A41D 19/002 150/106
1,970,081 A * 8/1934 Eisendrath ..... A41D 19/01535 126/204
1,982,431 A * 11/1934 Hines ..... A41D 19/002 2/160
2,103,594 A * 12/1937 Murray ..... A41D 19/002 2/160
2,432,325 A * 12/1947 McDougall ..... A41D 19/002 2/160

(Continued)

FOREIGN PATENT DOCUMENTS

CN 103371541 A 10/2013
WO 99/30584 A1 6/1999

*Primary Examiner* — Jameson D Collier
*Assistant Examiner* — Jocelyn Bravo
(74) *Attorney, Agent, or Firm* — Winston & Strawn LLP

(57) ABSTRACT

A heatable football glove that provides heat to a wearer's hand. The glove includes a body member that includes a pocket therein to accommodate a heating element of substantially the same size as the pocket such that the heating element after activation is introduced through an opening into the pocket where it is snugly received therein and conforms to the pocket in order to be retained therein substantially without movement during use of the glove. A covering member that is selectively movable between open and closed positions is provided for closing the opening and retaining the heating element in the pocket during use of the glove. An attachment member is associated with the covering member for releasably attaching or adhering the covering member to the glove to retain the heating element in the pocket during use.

17 Claims, 4 Drawing Sheets

(56) References Cited

U.S. PATENT DOCUMENTS 2,472,751 A * 6/1949 Le Clair ..... A41D 19/002 150/150
3,096,523 A 7/1963 Bruchas
3,105,972 A * 10/1963 Christopher ..... A63B 71/146 128/DIG. 15
3,606,614 A 9/1971 Dimitroff
3,712,288 A * 1/1973 Weiss ..... A41D 19/01535 126/206
4,042,975 A * 8/1977 Elliott, Jr. ..... A41D 19/01588 2/161.1
4,535,482 A * 8/1985 Spector ..... A61F 7/03 2/160
4,543,671 A * 10/1985 Monk ..... A41D 19/01535 2/158
4,654,895 A 4/1987 Peters
4,662,006 A * 5/1987 Ross, Jr. ..... A41D 19/01 2/158
4,670,909 A * 6/1987 Forrester ..... A41D 19/002 2/160
4,723,324 A 2/1988 Lassiter
4,764,665 A * 8/1988 Orban ..... A41D 19/01535 219/211
4,793,005 A * 12/1988 Hetzel, Jr. ..... A41D 19/01547 2/161.1
4,805,242 A * 2/1989 Bolton ..... A41D 19/002 2/160
4,850,052 A * 7/1989 Matthews ..... A41D 19/0024 2/160
4,881,276 A 11/1989 Swan
4,950,868 A * 8/1990 Moss ..... A41D 13/0051 219/211
5,003,637 A * 4/1991 Lonon ..... A41D 19/0024 2/160
5,117,509 A 6/1992 Bowers
5,187,814 A * 2/1993 Gold ..... A41B 11/00 2/160
5,214,799 A * 6/1993 Fabry ..... A41D 19/01523 2/161.6
5,345,368 A * 9/1994 Huff ..... A41D 19/0037 2/160
5,509,143 A * 4/1996 Yates ..... A41D 19/01535 2/158
5,617,583 A * 4/1997 Yates ..... A41D 19/01535 2/158
5,625,900 A * 5/1997 Hayes ..... A41D 19/00 2/159
5,706,521 A * 1/1998 Haney ..... A41D 19/0024 2/160
5,774,894 A * 7/1998 Yates ..... A41D 19/0041 2/158
5,829,061 A * 11/1998 Visgil ..... A41D 19/0013 2/161.6
5,898,938 A * 5/1999 Baylor ..... A41D 19/01523 2/161.1
D410,956 S * 6/1999 Adams Zurawin ..... D29/113
5,924,136 A * 7/1999 Ogean ..... A45C 1/04 2/159
5,926,847 A 7/1999 Elbert
6,006,357 A * 12/1999 Mead ..... A41D 19/0157 2/160
6,065,155 A 5/2000 Sandusky
6,105,162 A * 8/2000 Douglas ..... A41D 19/01523 2/161.1
6,141,801 A * 11/2000 Helenick ..... A41D 19/01535 2/159
6,233,742 B1 * 5/2001 Yungkurth ..... A41D 19/002 2/160
6,820,282 B1 * 11/2004 England ..... A41D 19/002 2/161.1
7,086,093 B2 * 8/2006 Carey ..... A41D 19/01529 2/159
7,140,046 B2 * 11/2006 Ono ..... A41D 19/01523 2/161.5
7,152,248 B2 * 12/2006 Ziemer ..... A41D 19/0157 2/160
7,451,496 B2 * 11/2008 Carey ..... A41D 19/01529 2/160
7,934,270 B2 * 5/2011 Kishino ..... A41D 19/01529 2/160
8,230,522 B1 * 7/2012 Bell ..... A41D 19/0037 2/160
8,291,516 B2 * 10/2012 Chen ..... A41D 19/0157 2/160
8,464,364 B2 * 6/2013 Hofeldt ..... A41D 19/01523 2/159
9,451,797 B1 * 9/2016 Ashkanani ..... A41D 19/0024
9,713,757 B2 * 7/2017 Wiseman ..... A63B 71/146
2001/0032347 A1 * 10/2001 Redwood ..... A41D 19/0024 2/160
2003/0154537 A1 * 8/2003 Carey ..... A41D 19/01529 2/160
2004/0244090 A1 * 12/2004 Langer ..... A41D 19/002 2/160
2005/0210562 A1 * 9/2005 Johnson ..... A41D 19/002 2/159
2007/0083979 A1 * 4/2007 Daniels ..... A41D 19/002 2/160
2007/0101479 A1 * 5/2007 Turner ..... A41D 19/002 2/159
2008/0189826 A1 * 8/2008 Dilli ..... A41D 19/01535 2/158
2008/0223844 A1 9/2008 Cronn
2009/0077711 A1 * 3/2009 Kim ..... A41D 19/01 2/158
2009/0083897 A1 * 4/2009 Kishino ..... A41D 19/002 2/160
2009/0229035 A1 * 9/2009 Van Hale ..... A41D 19/002 2/161.6
2010/0095947 A1 * 4/2010 Gellis ..... A41D 19/01535 126/263.01
2011/0072552 A1 * 3/2011 Johnson ..... A41D 19/002 2/160
2011/0088138 A1 * 4/2011 Chen ..... A41D 19/01535 2/160
2011/0214221 A1 * 9/2011 Munda ..... A63B 71/14 2/161.1
2011/0235310 A1 * 9/2011 Chen ..... B62J 29/00 362/103
2012/0079641 A1 4/2012 Kirchner
2015/0082514 A1 * 3/2015 Wiseman ..... A63B 71/146 2/160

* cited by examiner

HEAT PROVIDING FOOTBALL GLOVE

This application claims the benefit of provisional application 62/140,021 filed Mar. 30, 2015, the entire content of which is expressly incorporated herein by reference thereto.

BACKGROUND

The present invention relates to a heated football glove that is carefully designed to provide warmth to a football player's hands when performing in cold weather or severe weather conditions.

The prior art in general does not address the need for a football glove for use in extreme cold and wet weather. Prior art gloves designed for golf, baseball, or other sports do not suffice because they are not provided with the appropriate tightness of fit, impact resistance or adhesion properties for grasping or catching a ball.

In particular, for players on offense, football gloves need to be designed with the goal of maintaining ball control, primarily to facilitate catching the ball and or holding onto it when being tackled. For example, U.S. Pat. No. 6,065,155 discloses a football glove that includes a glove body having first and second regions, the first region including approximately the front half of the glove including the front half of all the fingers and all of the thumb region, the first region having a rubber-like softened PVC surface layer which is waterproof and has characteristics to improve catching of the football.

In addition to the use of tack material on the palm and fingers to assist in catching or grasping the ball, conventional high performance football gloves also provide a variety of additional features and benefits to protect the wearer's hand, improve comfort, and enhance performance, including:

- Breathable materials optionally with ventilation to allow sweat to pass through the glove structure and keep hands cool. Also, a mesh can be provided between the fingers, and ventilated backhands to improve air flow, release hot air, and generally keep the hands cool, dry, and comfortable.
- Padding such as lightweight, flexible foam padding in the palm or back side of the glove are typical in advanced lineman gloves, and help soften impacts to protect the hand.
- The use of high quality materials that allow the gloves to perform in all weather conditions. The improved strength of such materials keeps them functioning season after season. These materials have properties that typically include stretchable, synthetic materials with seamless or reinforced seamed construction.

While the foregoing designs and materials are useful in warm or moderate weather or when playing under a dome or indoors, they do not help the wearer keep his hands warm when the game is played on an outdoor field in cold or frigid weather with or without rain, snow and sleet. In particular, the breathable construction of the glove does not help keep the wearer's hands warm when exposed to very cold or frigid weather conditions. Also, when exposed to rain or snow conditions, moisture can enter into the glove through the breathable or mesh areas, thus detrimentally affecting the feeling and condition of the wearer's hands and the ability of the player to properly perform.

The use of heating in various gloves is disclosed in a number of patent documents, including U.S. Pat. Nos. 3,606,614, 4,543,671, 4,764,665, 4,950,868, and 6,141,801 and US patent application 2004/0244090. None of these gloves, however, are suitable for use as a football glove, nor can they be modified for use in a football game.

A summary of general football gloves that are designed to provide warmth to the user's hands can be found in US patent publication 2011/0214221. None of the gloves disclosed in that application have any kind of heating means, however, such that their use in extremely cold weather is generally ineffective. And as a player's hands become cold due to exposure to low temperatures for extended periods of time, they are not able to properly catch or hold onto the football with dropped passes or fumbles as a result. Thus use of a tack coating provides some benefit but it cannot completely compensate for or remedy the disadvantages of extremely cold hands that are trying to catch or hold a ball.

Thus, there remains a need for a football glove that can be used in cold and wet weather conditions which provides the appropriate fit, warmth for the hands and appropriate surface properties to facilitate handling of the football. The present invention now satisfied these needs.

SUMMARY OF THE INVENTION

Accordingly, the present invention now provides a heatable football glove that provides heat to a wearer's hand comprising a body member for covering a person's hand including palm, finger, thumb, knuckle, wrist and back side portions, wherein the thumb and finger portions fully cover the person's fingers. The body member has an opening on the back side portion and a pocket member is provided beneath the back side portion of the body member. The pocket extends from the knuckle portion to the wrist portion and is accessible through the back side portion opening. The pocket is configured and dimensioned to cover the user's knuckles and to extend to the wrist portion. Also, it is securely attached to the glove to avoid movement in the glove during use.

The glove includes a heating element comprising a pouch that encloses a heat generating material that is activated by contact with air, wherein the heating element is configured and dimensioned to be of substantially the same size as the pocket such that the heating element after activation is snugly received in and conforms to the pocket in order to be retained therein substantially without movement during use of the glove. A covering member is also provided for closing the opening and retaining the heating element in the pocket during use of the glove. In particular, the covering member is selectively removable from a first position where the opening is exposed to allow insertion or removal of the heating element therein or therefrom, to a second position where the covering member closes the opening and is attached or adhered to the glove. Additionally, an attachment member is associated with the covering member and wrist portion of the glove for releasably attaching or adhering the covering member to the glove to retain the heating element in the pocket during use of the glove.

Advantageously, the heating element and pocket are provided with a generally rectangular shape that conforms to the back of the users hand and with tab portions that extend from sides of the rectangular shape and over the users knuckles. Additionally, the tab portions of the heating element and pocket are rounded and do not extend into the finger portions of the glove, and wherein the pocket is secured in place by stitching to the body member. As a further feature, the heating element and pocket are configured to include side portions or wings that cover the sides of the wearer's hand from the index finger portion to the thumb portion and from the pinky finger portion towards the wrist portion.

The covering member is generally shaped to conform to the back portion of the hand and the attachment member preferably comprises hook and loop fasteners, snaps, a zipper or buttons and buttonholes, with part of the attachment member provided on the covering member and a mating part provided on the back portion of the glove to allow the covering member to be releasably attached to the back portion of the glove. One end of the covering member is permanently affixed to the back portion of the glove while the opposite end includes part of the attachment member, with the back portion of the glove including a mating part of the attachment member in position to receive the covering member in snug contact therewith over the opening and against the back portion of the glove.

The covering member may be affixed to the glove by a seam that extends substantially horizontally from below the index finger portion to the pinky finger portion beneath the knuckle portion with the attachment member provided in the wrist portion and with the pocket opening extending substantially horizontally in a position below the first finger to below the pinky finger portion.

Alternatively, the covering member may be affixed to the glove by a seam that extends substantially vertically from below the index finger portion to the wrist portion with the attachment member provided in a vertical orientation extending from below the pinky finger portion to the wrist portion with the pocket opening extending vertically between the second and third finger portions.

Preferably, the glove further comprises a continuous or discontinuous tacky material, coating or layer on the palm portion of the glove including the palm area and the palm side of the thumb and finger portions. This is especially desirable for gloves that are to be used by running backs or receivers. The tacky material, coating or layer is present upon and preferably completely covers the palm side of the glove including the palm portion and the thumb and finger portions.

The back side portion of the glove conveniently includes a layer between the pocket and outer surface that includes or is made of a heat reflecting material so that the heat emanating from the heating element is directed back towards the wearer's hand.

The wrist portion of the glove generally includes a closure element for tightening the glove onto the wearer's wrist to prevent dislodgment of the glove during use.

BRIEF DESCRIPTION OF THE DRAWINGS

The features and benefits of the present invention are better understood by a review of the following detailed description which is provided along with the appended drawing figures wherein.

DETAILED DESCRIPTION OF THE INVENTION

Figure 1:
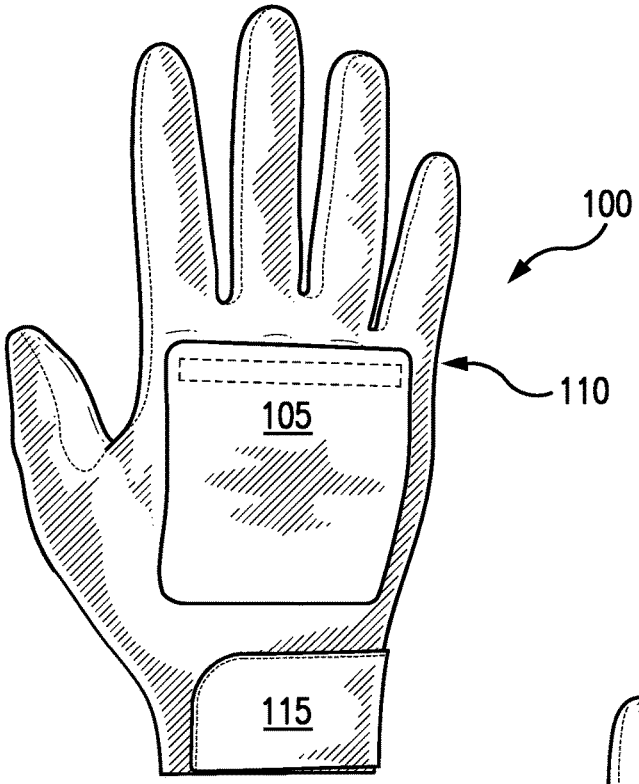
FIG. 1 is a view of the back side of the glove on the invention showing one embodiment of a pocket covering.

The present invention relates to a football glove which is specifically design for and used when playing or practicing football. A football glove must be rugged as well as durable as it experiences contact, impact, abrasion, moisture, dirt or mud and other actions or conditions that affect the performance of the glove. The construction of the glove is selected such that is conforms closely to the user's hand and it tightened thereof by a wrist strap. Additionally, the provision of a heating element that snugly fits within a pocket in the glove that maintains the element in the position for heating the back of the wearer's hand without movement during use throughout the game due to contact or impact. The heating element and pocket are configured to essentially the same dimensions to hold the element in the pocket in the correct heating position.

To help understand the invention and the orientation of the component parts of the glove, the following designations will be used. As shown in the drawings, the glove includes a body member that is shaped in the same way as a user's hand so that for convenience the glove of the present invention will be described with portions that correspond to the parts of the human hand that it contacts.

The glove includes a body member that snugly fits an average user's hand for the sizes mentioned. The body member will include finger portions for covering each finger, including an index finger portion, second finger portion, third finger portion and pinky finger portion, a thumb portion for covering the thumb, a wrist portion for covering at least a portion of the wearer's wrist, a palm portion for covering the area between the finger and wrist portions on the front side of the user's hand and a back side portion for covering the back side of the user's hand from the finger portions to the wrist portion including a knuckle portion for coverage of the wearer's knuckles. The front of the glove that covers the palm and front sides of the fingers will be referred to as the palm side of the glove while the back of the glove that contacts the back side of the hand and fingers will be referred to as the back side portion of the glove. The glove also includes a side portion that covers the side of the hand between palm and back side extending from the end of the index finger portion to the thumb portion and an opposite side portion that covers the side of the hand between palm and back side extending from the pinky finger portion to the wrist portion.

The football gloves of the present invention improve the player's performance on the gridiron by providing heat and warmth to their hands in extreme weather conditions while also protecting the backs of their hands from impact as well as providing extra grip to control the ball. These gloves also provide additional features such as light weight, flexibility, and a conformance fit. There are slightly different football gloves according to the invention depending upon the player's position. These include:

Receivers and Running Back Gloves—Receivers and running backs need to control and hold onto the ball, while remaining light weight. Gloves designed for these players feature:

- Enhanced palm grip or tack coating or layer;
- Extended tack from the palm, around the fingers, and onto the thumb on part or preferably the entire front or palm side of the glove;
- Lightweight, flexible construction of a weather resistant material on the back side of the glove.

Lineman Gloves—Lineman take the hardest repetitive and almost constant hits on the field, so their gloves are built tougher, to protect their hands and fingers from damage, abrasion, and hyperextension. Most lineman gloves feature:

- Rigid frames and finger stays to prevent fingers from bending back during play;
- Heavier, more durable materials than receiver gloves, to withstand more abuse;
- Little to no tackiness on the palm side as they do not usually handle the ball;
- Enhanced palm and back side padding, to protect the hands from impact.

The following conventional groves are typical of preferred football gloves for use by both professionals and amateurs. The basic construction of each glove is suitable for use in the present invention, with each glove being redesigned to have sufficient internal space to accommodate the pocket and heating element, and with the outer layer including a pocket opening and covering member. These conventional gloves include:

Under Armour F3 Gloves that feature a super-sticky Armour® GrabTack palm and rollover thumb. A seamless, one-piece palm with numerous perforations helps eliminate sweat build-up. Additional features of this glove include a breathable, ultra-light and durable stretch woven construction for the back side portion, a construction that secures thumbs and index fingers to reduce twisting, reflective trip details for visibility, and a molded CompFit wrist cuff with closure tab for securing the gloves on the player's hands. Under Armour also makes Nitro Gloves, which has many of the same features found in the F3 Gloves but with additional differences with regard to the details of the reflective trim.

Nike Vapor Jet 2.0 Football Gloves, which are built with Magnigrip CL material between the fingers and on the palm to deliver superior grip and durability in all conditions. It also includes an ultra-light construction that includes a gusset system for greater range of motion, catching surface area and control, an adjustable wrist strap with hook and loop (VELCRO® brand) fasteners for a locked-down fit, and pre-curved fingers for reduced bunching, increased grip area and a more natural fit. The glove material is 62% polyester/18% nylon/12% silicone/8% neoprene.

Adidas Supercharge 2 Gloves which offer a GripTack Palm, delivering a dual-coated treatment that performs in all weather conditions. Lightweight, multidirectional stretch compression and a smooth neoprene band allows this glove to provide a fit that moves with the fingers, palms, and wrists. It also includes vented mesh finger inserts and an expansion recess between thumb and index finger.

Cutters C-Tack Revolution Glove which features an exclusive and proprietary C-TACK™ Revolution Performance Grip Material to provide the best combination of performance and durability in a glove that provides an improved fit and a lighter weight. The glove performs in all weather conditions and is also machine washable and dryable.

Each of the foregoing gloves discloses different tack coatings or layers which are eminently suitable for use in the present invention. And while breathability of the back side of the hand is not preferred for use in the present invention due to potential heat loss from the heating element, many of the other features of such gloves are desirable for use in the present invention. The final construction of the glove can depend upon the desires of a skilled artisan in developing an optimum glove for a particular performance situation, i.e., to protect the player's hands against frigid cold, wet snow, or combined rain/snow conditions during a game that is played outdoors rather than in a dome. For this reason, one or more of the various features of existing gloves can be incorporated into the heatable football gloves of the present invention.

For running back and receiver gloves, the most important additional feature to include is the tack coating or layer on the palm side of the glove to facilitate catching and holding onto the ball when running or being tackled. Different glove manufacturers design their gloves with different types and styles of palm grip tack material to provide different levels of tackiness and control on the ball. These gloves are particularly designed for receivers and running backs. The following are popular varieties of grip surfaces for use in the present invention:

Cutters C-Tack layer, because it provides a robust and permanent tacky grip that actually restores when washed or cleaned.

Nike Magnigrip CL, which delivers a solid grip and lasting durability during use.

Armour GrabTack, which provides an extremely sticky grip that is extended over the thumb for added ball control.

Adidas Seamless Double-Coated High-Gloss Silicone Palm which also provides a solid grip of silicone material that extends around the thumb.

Neumann Tackified Leather Palm, which is a basic thin treated leather palm grip for gloves that fit tightly, giving players a natural feel and grip on the ball.

The material on the palm of the glove can be treated or coated to enhance catching and gripping abilities. Generally, conventional football glove palms are either made of latex or cabatta leather, a thin leather material that is treated with chemicals that increase tackiness and provide a better ball grip. This leather material is also extremely soft, flexible and durable. Gloves with latex palms provide the best fit and flexibility but are not as durable and can get slippery in wet weather. This is why the present invention prefers to include one of the premium tack coatings or layers described herein on the palm side of the glove.

The most preferred tack or grip material used on the gloves of the invention is the Cutters' C-Tack layer, because this material is provided as a layer that forms part of the palm side of the glove rather than a coating such that it does not wear away quickly and it can be wiped down after use or even cleaned in a washing machine after use.

The palm portion and finger portions on the palm side of the glove are generally uniformly coated or provided with a coating or layer of the tack material. Depending upon the precise weather conditions expected when used, e.g., a cold but dry day, the players may also use gloves that have a discontinuous or patterned application of grip material on the palm and finger portions, and those configurations are also included as additional embodiments of the present invention. As a skilled artisan is well aware of the various tack coatings or layers that are available, these are not specifically illustrated by the drawings.

Figure 2:
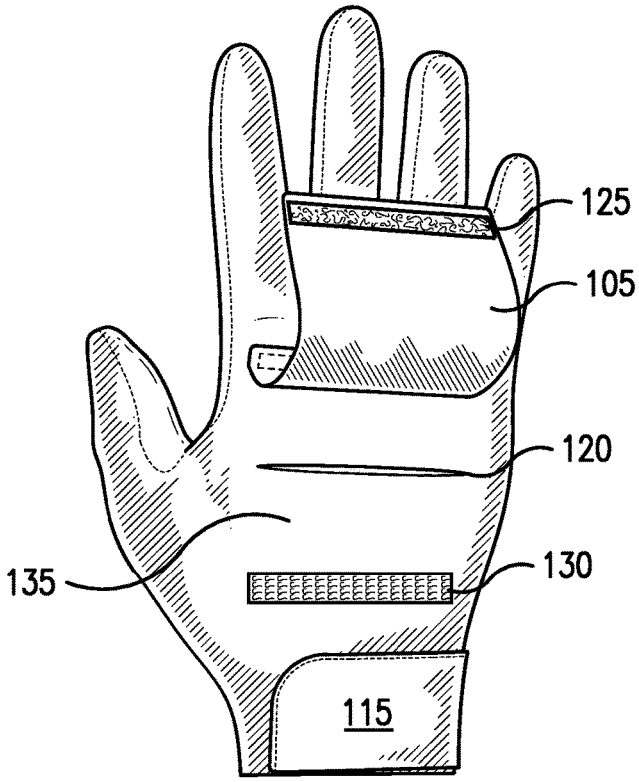
FIG. 2 is a view of the back side of the glove of FIG. 1 with the covering moved to an open position to expose the pocket opening.

Referring now to the drawing figures, FIGS. 1 and 2 illustrate the back side of a glove 100 according to the present invention showing one embodiment of a pocket covering member 105. The covering member 105 is secured to the back side portion of the glove near or just below the knuckle portion 110 by sewing, stitching or by an adhesive. The covering member extends to the lower part of the back side portion near wrist portion 115. Wrist portion 115 also includes a conventional closure element, which preferably is a hook and loop fastener, to tighten the glove onto the wearer's wrist.

As shown in more detail in FIG. 2, the outer shell is provided with opening 120 that provides access to the pocket that receives the heating element. The covering member 105 is secures the heating element in the pocket during use by closing over opening 120. The free end of the covering member 105 is provided with part of an attachment member, shown schematically in the figure as hook material 125 that engages loop material 130 that is securely attached to the outer shell of the glove in the lower part of the back side portion 135 just above the wrist portion 115.

Figure 3:
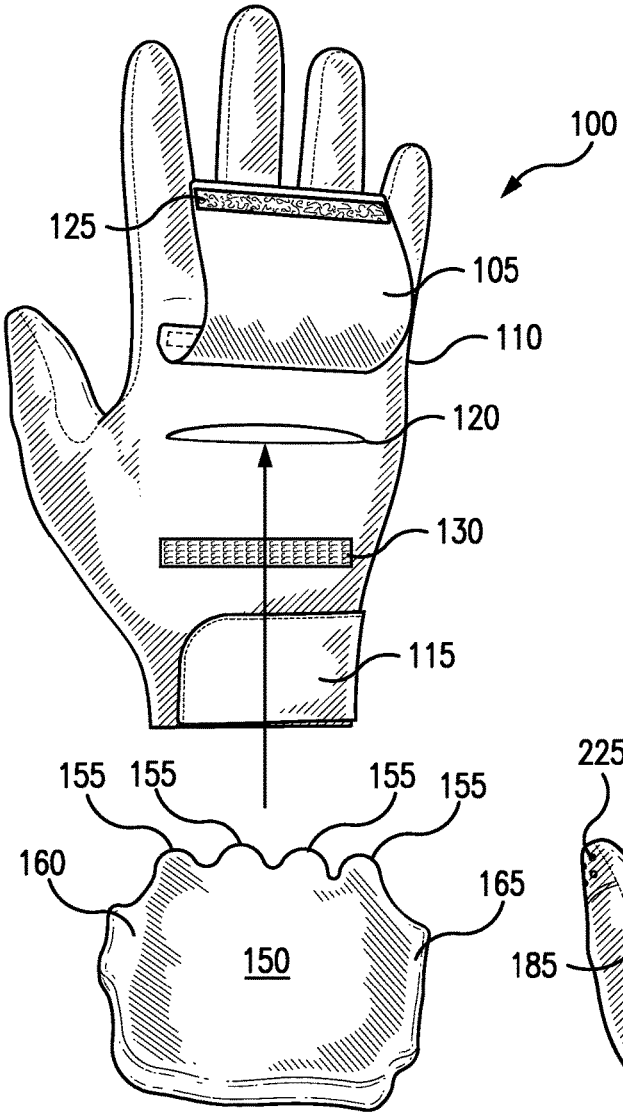
FIG. 3 is a view of the glove of FIGS. 1 and 2 to illustrate a preferred heating element and how it is introduced in the pocket.

FIG. 3 illustrates the heating element 150 that is inserted into the pouch pocket of the glove 100 through generally horizontal opening 120. In the most preferred embodiment, the heating element is shaped as shown in this figure, with tab portions 155 that approach the openings to the four finger portions, and that are placed beneath the knuckle portion 110 of the glove over the wearer's knuckles. The upper end of the tab portions are generally round or oval with the largest length being about 2 to 3 cm and with each having a width of 1 to 2 cm. The heating element 150 also includes a first side portion 160 that is configured and dimensioned to cover the side of the wearer's hand between his palm and backside portion. The inside portion 160 also extends from the end of the index finger portion to the thumb portion. The first side portion 160 has a length of about 2 to 4 cm and a width of about 2 to 3 cm. The heating element 150 also includes a second side portion 165 that covers the side of the wearers hand between the palm and backside but extending from the end of the pinky finger portion to the wrist portion. The second side portion 165 has a length of about 5 to 10 cm and a width of about 2 to 4 cm.

Figure 6:
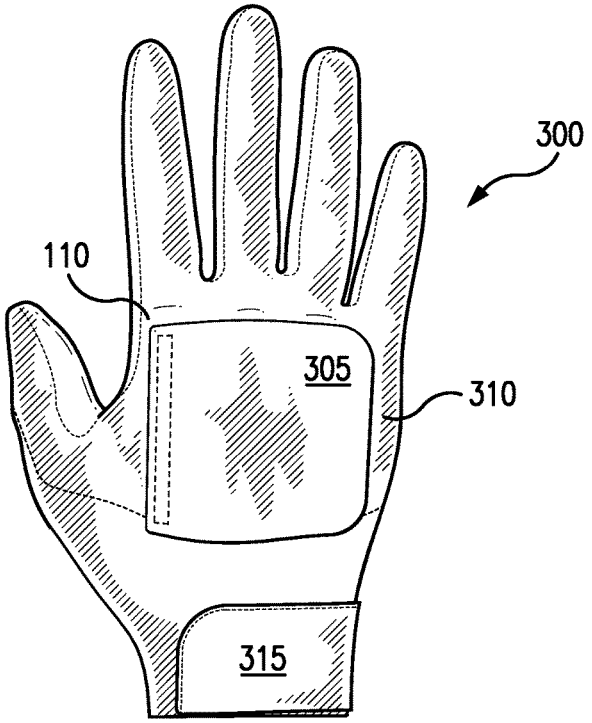
FIG. 6 is a view of the back side of the glove of the invention showing an additional embodiment of a pocket covering.
Figure 7:
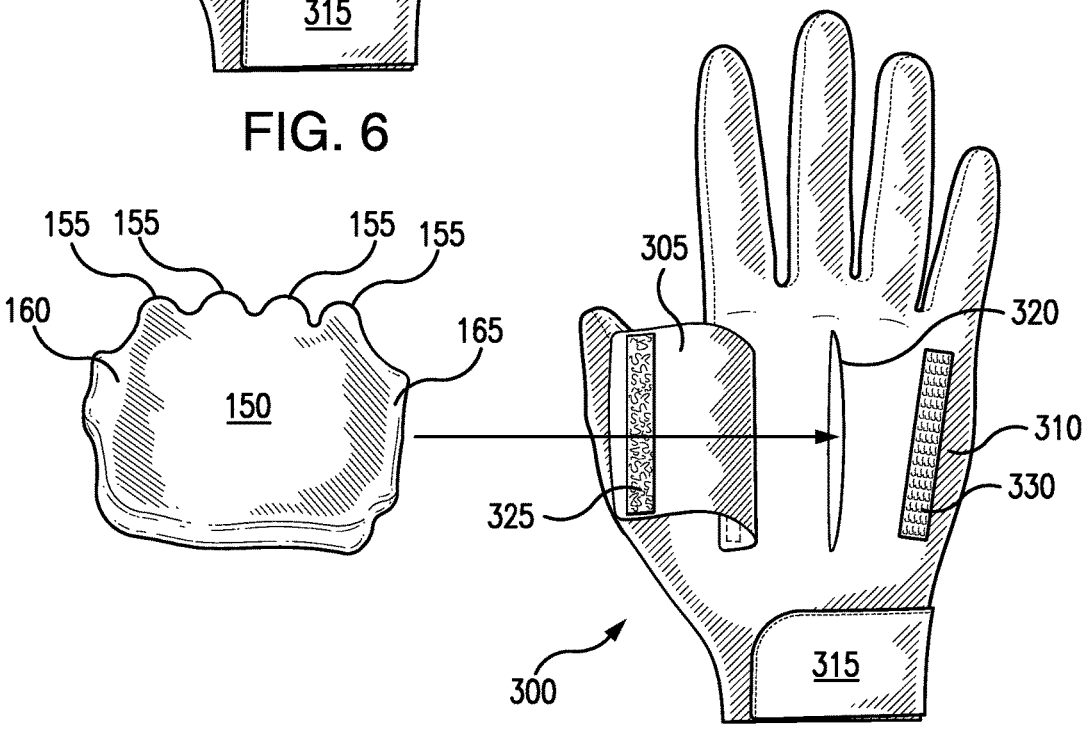
FIG. 7 is a view of the back side of the glove of FIG. 6 with the covering moved to an open position to expose the vertical pocket opening.

FIGS. 6 and 7 illustrate an alternative embodiment of the back side of a glove 300 according to the present invention showing a differently arranged pocket covering member 305. The covering member 305 is secured to the back side portion of the glove near or just below the knuckle portion 110 of the index finger portion by sewing, stitching or by an adhesive. The covering member extends to the side part of the back side portion 310 below the pinky finger portion. As in FIGS. 1-3, a wrist portion 315 is provided that includes a conventional closure element, which preferably is a hook and loop fastener, to tighten the glove onto the wearer's wrist.

As shown in more detail in FIG. 7, the outer shell is provided with opening 320 that provides access to the pocket that receives the heating element 150. The covering member 305 is secures the heating element in the pocket during use by closing over opening 320. The free end of the covering member 305 is provided with part of an attachment member, shown schematically in the figure as hook material 325 that engages loop material 330 that is securely attached to the outer shell of the glove in the side part of the back side portion 310 below the pinky finger portion.

FIG. 7 illustrates the same heating element 150 as in FIG. 3. The heating element 150 is inserted into the pouch pocket of the glove 100 through vertical opening 120 along the direction shown by the arrow. The pocket would be configured in the same manner as in FIG. 3 and as further described herein with regarding and as preferably shown in FIG. 4.

Alternatively, for these embodiments, the heating element can be configured in a generally rectangular shape that conforms to the approximate size of the backside portion of the glove to provide heat to the entire back side of the wearer's hand. This rectangle would have dimension of 6 to 9 cm wide and 5 to 8 cm long. A circle, ellipse or polygon shape can also be used but these are not preferred to the rectangle or FIG. 3 shape as those provide much better coverage of the entire back portion of the glove to provide heat to the back of the wearer's hand.

For any of the heating element embodiments, the pocket in the glove that receives the heating element will be sized and shaped to conform closely to the size and shape of the heating element 150, preferably an preferably in contact with the inner periphery of the pocket. The heating element is inserted into the pocket through opening 120 as shown by the arrow in FIG. 3. To facilitate such insertion, the heating element 150 can be made to be somewhat flexible so that it can be folded or otherwise made smaller to fit through the opening and then expanded into the pocket. As discussed herein, the pocket can be made of a flexible material that is not affixed to the glove on all sides so that it can expand to snugly receive the heating element therein while being adhered to the other layers of the glove to be maintained in the desired position.

While a simpler construction for the heating element and pocket is possible, it is preferred for the outer perimeter to be more complex so that the pocket can retain the heating element therein without movement during use. The covering member also assists in tightening the pocket and heating element against the back of the wearer's hand so that it does not move during use of the glove during a game.

The preferred heating element is one that includes an air activated composition that is generally a mixture of iron powder, charcoal, salt, sawdust, and vermiculite. The composition is provided in a fabric, paper or plastic sheet or film structure of desired dimensions with the sheet or film having sufficient porosity to allow air and oxygen to enter therein to activate the mixture so that it can generate heat. The mixture is non-toxic and odorless and the heating element functions as a non-electrical and non-fuel burning element which generates and transmits heat energy to the hand of the wearer. The structure and composition are provided in a sealed pouch until use, and can be activated simply by opening the pouch and removing the structure from the pouch. When exposed to the air, an oxidation process takes place in the mixture to generate heat, and depending upon the formulation, these products can generate heat for up to 10 to 20 hours or more. For the present invention, that would be more than enough as a heat generating time of about 5 to 6 hours usually would be more than sufficient to last throughout a game.

Figure 4:
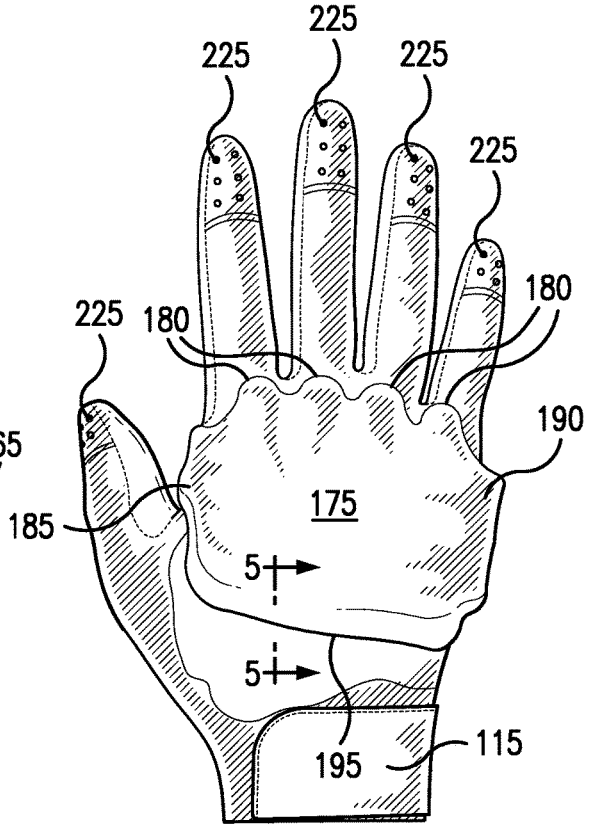
FIG. 4 is a view of another embodiment of the back side of the glove of the invention with a cut-away view of the back side and removal of the covering member to show the position of the heating element and pocket in the glove.

FIG. 4 illustrates the pocket 175 of the invention. The pocket 175 is configured, dimensioned, sized and shaped to more or less conform or match that of the heating element 150. As shown, the pocket includes upper recesses 180 for receiving the tab portions 155 of the heating element 150. The recesses 180 provides guidance for the insertion of the similarly dimensioned tab members 155 of the heating element 150. Pocket 175 also includes one expanded portion or space 185 that receives side portion 160 and another 190 for receiving side portion 165 of the heating element. The expanded portions of the pocket provide further stability of the placement of the heating element in the pocket to prevent lateral movement of the heating element during use.

In a preferred embodiment, the upper recesses of the pocket and lower and 195 are sewn or otherwise secured to the inner lining or inside of the glove so that the pocket cannot move during use. The sides that include extended portions 185, 190 or left free to assist in receiving the heating element 150 therein. FIG. 4 illustrates these extended portions as being outside of the glove for clarity whereas in use they would be in contact with the sides of the user's hand. Various alternative pocket arrangements or configurations are discussed hereinbelow for attaching or securing the pocket to the glove.

As for the construction of the glove itself, the glove body may be of a single ply construction, such as is found in conventional glove liners, with a single ply outer shell which defines tightly fitted finger pockets, a thumb pocket, and the palm and back side portions for contacting the hand. The shell may optionally extend proximally beyond the palm and back side portions to a wrist portion that covers the user's wrist. The outer shell is made of a water resistant material or structure that prevents water from passing through the outer shell.

The specific construction of the football gloves of the invention can also vary depending upon the manufacturer's preferences. Generally, the outer layer or shell are made of leather because this material is comfortable and is very flexible, so they do not hamper the wearer's grip or performance. The gloves of the present invention may have an outer shell of any suitable material although a leather glove of substantially conventional external design and construction is preferred.

In a preferred embodiment of the invention, the glove body has a two-ply construction that includes the outer shell and an inner liner or layer of a suitable fabric. This combination provide greater comfort when the wearer's hand is placed into the form fitting glove. Preferably, the inner shell is thin, e.g. 1-5 mm and more preferably 2-4 mm, in uncompressed thickness, to provide comfort along with good flexibility and tactile sensitivity. The inner, lining layer or shell may be constructed from a variety of materials, such as cotton, nylon, wool, polypropylene, SPANDEX® or other natural or synthetic fibers of similar texture and flexibility commonly used in the textile industry. The selection of materials, weaves, and shell thicknesses will also depend on the type of glove (i.e., lineman or running back, etc.) as these have different insulation requirements, whereby the shell must provide for effective transmission of heat from the heating element to the hand while at the same time insulating the wearer against discomfort or burns due to excessive heat transmission. In this two-ply configuration, the outer layer or shell is shaped and dimensioned to cover and closely conform to the inner, lining, and thus is defined with similarly shaped, but slightly larger finger pockets, thumb pocket, and palm, back side portions, and wrist portions.

In this regard, it is noted that a receiver or running back glove would desirably be thinner so that an additional layer of fabric would not be preferred. For lineman gloves, additional layers would be acceptable to provide additional protection for their hands.

The pocket and heating element can be provided in either the single or two ply glove constructions in any one of a variety of ways. The simplest arrangement is to provide the pocket as a separate component which is sewn, stitched or otherwise adhered to the inside of the single ply or double ply glove. Having the pocket entirely separate from the inner lining and the outer layer, allows the pocket to have all sides continuously joined together to form the pocket but with only certain portions of the periphery or boundary attached, e.g., by sewing or stitching, onto one or preferably both layers of the glove.

Alternatively, in a two-ply glove construction, the heating element can be positioned in a pocket that is formed between an inner liner and the outer layer. This, for example, would allow for placement of the heating element directly against an outer surface of the inner shell with the inner liner providing a fabric surface between the wearer's hand and the heating element. The pocket is formed by sewing or stitching the inner lining to the outer layer in a pattern that provides an outline that matches that of the heating element.

In another aspect of the two-ply glove design, the pocket and heating element are provided between the inner, lining layer and the wearer's hand. In this embodiment, the pocket is formed by attaching an additional layer of fabric to the inner lining by sewing or stitching in a pattern that provides an outline that or boundary for the pocket that conforms closely to the shape of the heating element. The inner layer is then sewn or adhered to the outer layer in order to help maintain the pocket and heating element in the correct position in the glove.

By "conforms closely" what is meant that the heating element is snugly received in the pocket essentially in contact with the pocket boundary or sewing seams. Of course, a small tolerance of about 1 to 6 mm (up to a quarter inch) and preferably not more than 3 mm (⅛") is provided to facilitate the introduction of the heating element and to retain the heating element in the correct position in the glove on the back of the hand.

Below the outer shell and heating element is a material that acts as a heat reflector to direct heat emanating from the heating element back towards the wearer's hand. This material may be a reflective foil such as an as aluminized plastic film bonded to the outer layer or upon a support. Depending upon the glove construction, the heat reflective layer can be applied to the back of the inner liner, the inside surface of the upper layer of the pocket, or the inside of the outer layer. It also can be provided on a fabric support that is used in place of or in addition to the inner liner.

Figure 5:
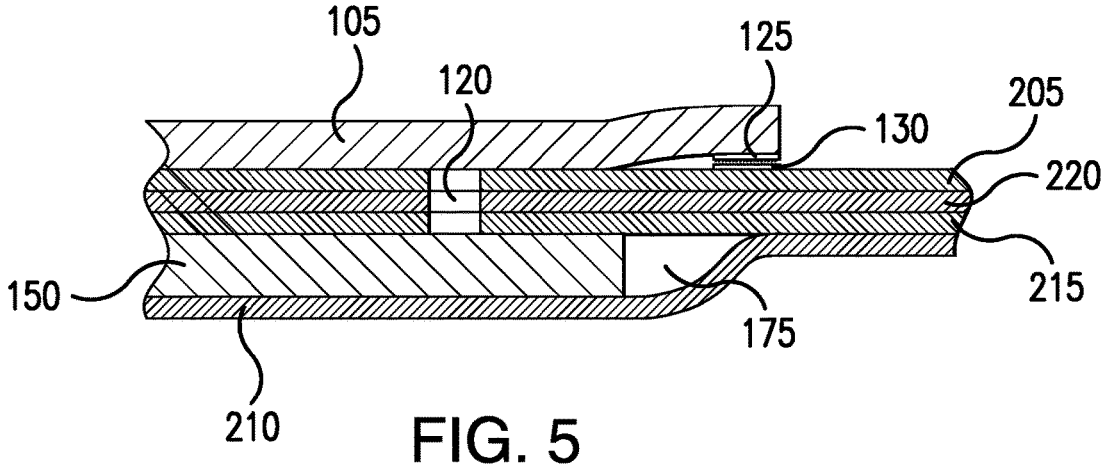
FIG. 5 is a cross sectional view of the glove of FIGS. 1-4 taken along section line 5-5 of FIG. 4.

FIG. 5 illustrate the construction of a preferred pocket and heat reflective layer. Heating element 150 is illustrated in a separate pocket 175 provided on the inner surface of a two ply glove having outer shell 205 and inner lining 220. The heating element is located in the pocket 175 between an inner fabric layer 210 and outer fabric layer 215. As discussed herein, the heat reflective layer can be provided as a layer, coating or deposition on the inner surface of the fabric layer 215, the outer surface of fabric layer 215, the inner surface of inner liner 220, the outer surface of inner liner 220, or the inner surface of outer shell 205 as selected by the glove designer. Each of these configurations orients the heat reflective layer to direct the heat back towards the wearer's hand. Depending upon the glove construction, certain of the layers shown in FIG. 5 may not be present but the heat reflective layer when used should be included on the inner surface of a fabric or layer that is located between the heating element and outer shell.

The heat reflective layer only needs to be as large as the pocket so that it reflects the heat emanating from the heating element back towards the center of the glove and the back of the user's hand. When a separate pocket is provided, the heat reflective material can be provide just on the inner surface of the upper fabric layer. In other embodiments, if desired for ease of construction or otherwise, the entire inner surface of the back side portion of the inner or outer layer of the glove can be provided with heat reflective material to form a complete layer.

A number of other materials are useful as the heat reflecting material or layer. This includes a metalized layer of a fabric or other flexible substrate that includes a deposit of a metallic material on one surface to form a relatively thin metal coating. The metalized layer is positioned in the glove with the metalized surface outside of the heating element and pocket so that as much of the heat generated by the heating element is reflection by the metal coating back towards the wearer's hand. The metal coating may be formed by vapor deposition although other processes for applying a metal coating to the substrate through thermal bonding, chemical bonding, laminating or any form of adhesive can also be used. Preferably, the metallic material used for the metal coating is aluminum which is applied to a surface of substrate. The substrate of the metalized layer can also be mylar, or a thin sheet of plastic such as polyethylene terephthalate (PET) as these can reflect up to 97% of the radiant heat it receives on its surface. Other materials that can be used for the substrate are polyester, spandex, fleece, lycra, cotton, nylon, wool, acrylic, rayon fabric or any combination of such materials in a blended fashion.

To further direct the heat generated by the heating element towards the finger portions of the glove, a controlled venting arrangement can be provided. FIG. 4 illustrates this feature. As the back side of the glove is not made of a breathable fabric, small pores or openings 225 are provided on the back side of the finger portions near the tips thereof to provide limited breathability of the glove. This assists in directing and distributing part of the heat that is generated by the heating element to travel toward the tips of the finger portions to warm the entire finger portion and the wearer's fingers.

And as noted herein, the covering member 105, 305 can be provided at any suitable location on the back side of the glove to cover and close the pocket which receives the heating element. A preferred arrangement is a covering element that has a flap which is sewn on one side to the glove and on the opposite side can be secured in place on the glove by a hook and loop fastener, such as that sold under the trademark "Velcro". Other suitable fasteners may be used, such as snaps, zippers, button and button-holes or the like. The hook and loop fastener arrangement is preferred for ease of use and to facilitate quick changes such as when the heating element is spent and needs to be replaced during a game, as this can be done rapidly during a timeout by the equipment manager. The closure can be peeled off easily for removal of the spent heating element and for the introduction of a new one before closing the opening with the hook and loop closure.

The opening 120,320 that provides access to the pocket is shown as substantially horizontal or substantially vertical in the preferred embodiments. Of course, any particular opening orientation can be used provided that it can provide access to the pocket. One preferred feature of the invention is to provide the opening with a small width in order to prevent heat losses through the opening. While the covering member assists in retaining heat in the glove, the thin width of the opening also helps this while not presenting a problem for the introduction of the heating element because the outer shell of the glove typically has some stretch and give to allow the flexible heating element to be passed therethrough. Of course a skilled artisan can best determine the size of the opening to facilitate the introduction and removal of the heating element. Also, when larger size openings are desired, the underside of the covering member 105,305 can be provided with a heat reflecting layer to help maintain the heat in the glove.

In the present invention, in addition to retaining the heating element inside the pocket, the covering member also may be designed with padding to assist in protecting the wearer's hands from impact or contact. This feature is more desirable for a lineman or linebacker glove since those players experience more contact on each play. In fact, instead of providing a tack surface on the palm side of the glove, a lineman or linebacker glove could be designed with additional padding on that surface to further protect the wearer's hands during the game.

Accordingly, the present invention accommodates different kinds of football gloves for different playing positions. So while a lineman's glove should be heavily padded on the top and the wrist and even on the palm side, a linebacker would benefit from a glove that is heavily padded but at the same time is more flexible and soft and has at least some tack surface to help when intercepting a pass or falling on a loose ball. Softer and more flexible gloves with a sticky or tacky palm are better suited for running backs and receivers while a defensive back's gloves should not just have the same qualities, but should also be padded on the upper to resist impact.

In view of the wide variety of embodiments to which the principles of the present invention can be applied, it should be understood that the illustrated embodiments are exemplary only, and should not be taken as limiting the scope of the present invention. Furthermore, the claims should be read to cover all embodiments that come within the scope and spirit of the invention including equivalents thereto.

What is claimed is:

1. A football glove that is configured to provide heat to a wearer's hand, comprising:

a body member configured for covering the wearer's hand, the body member including palm, finger, thumb, knuckle, wrist and back side portions, wherein the thumb and finger portions are configured to fully cover the wearer's fingers and include at least an index finger portion and a pinky finger portion, with the body member having an opening on the back side portion;

a pocket provided beneath the back side portion of the body member, the pocket extending from the knuckle portion to the wrist portion and being accessible through the back side portion opening, wherein the pocket is configured and dimensioned to cover the wearer's knuckles and to extend toward the wrist portion and is securely attached to the glove to avoid movement in the glove during use;

a heating element comprising a pouch that encloses a heat generating material that is configured to be activated by contact with air, wherein the heating element is configured and dimensioned to be of substantially the same size as the pocket such that the heating element after activation is snugly received in and conforms to the pocket in order to be retained therein substantially without movement during use of the glove;

a covering member for closing the opening and retaining the heating element in the pocket during use of the glove, wherein the covering member is selectively removable from a first position where the opening is exposed to allow insertion or removal of the heating element therein or therefrom, to a second position where the covering member closes the opening and is attached or adhered to the glove; and an attachment member associated with the covering member and wrist area of the glove for releasably attaching or adhering the covering member to the glove to retain the heating element in the pocket during use of the glove, wherein the heating element pouch is configured to conform to and provide heat to the back of the wearer's hand and includes two side wings, one of which is configured to extend to a side portion of the body member between the palm and the back side portion that extends from a bottom of the index finger portion to a bottom of the thumb portion, and the other of which is configured to extend to a side portion of the body member between the palm and the back side portion that extends from a bottom of the pinky finger portion towards the wrist portion.

2. The glove of claim 1 wherein the heating element and pocket are provided with a generally rectangular shape that is configured to conform to the back of the wearer's hand and with tab portions extending from a top side of the rectangular shape and configured to at least partially extend over the wearer's knuckles.

3. The glove of claim 2 wherein the tab portions of the heating element and pocket are rounded and do not extend into the finger portions of the glove, and wherein the pocket is secured in place by stitching to the body member.

4. The glove of claim 1 wherein the covering member is shaped to conform to the back portion of the glove, and the attachment member is selected from the group consisting of: hook and loop fasteners, snaps, a zipper, and buttons and buttonholes; wherein part of the attachment member is provided on the covering member, and a mating part is provided on the back portion of the glove to allow the covering member to be releasably attached to the back portion of the glove.

5. The glove of claim 4 wherein one end of the covering member is permanently affixed to the back portion of the glove while the opposite end includes part of the attachment member, with the back portion of the glove including the mating part of the attachment member in position to receive the covering member in snug contact therewith over the opening and against the back portion of the glove.

6. The glove of claim 5 wherein the covering member is affixed to the glove by a seam that extends substantially horizontally from below the index finger portion to the pinky finger portion beneath the knuckle portion with the attachment member provided in the wrist portion and with the pocket opening extending substantially horizontally in a position below the first finger to below the pinky finger portion.

7. The glove of claim 5 wherein the finger portions include the index finger portion, a second finger portion, a third finger portion, and the pinky finger portion; and wherein the covering member is affixed to the glove by a seam that extends substantially vertically from below the index finger portion to the wrist portion with the attachment member provided in vertical orientation extending from below the pinky finger portion to the wrist portion with the pocket opening extending vertically between the second and third finger portions.

8. The glove of claim 1 further comprising a continuous or discontinuous tacky material, coating or layer on the palm portion of the glove including the palm area and the palm side of the thumb and finger portions.

9. The glove of claim 8 wherein the tacky material, coating or layer completely covers the palm portion of the glove including the palm area and the palm side of the thumb and finger portions.

10. The glove of claim 1 wherein the heating element includes an air activatable composition that includes a mixture of iron powder, charcoal, salt, sawdust, and vermiculite.

11. The glove of claim 1 wherein the back side portion of the glove includes a layer between the pocket and an outer surface of the glove, the layer including a heat reflecting material configured so that the heat emanating from the heating element is directed towards the wearer's hand.

12. The glove of claim 1 wherein the wrist portion further comprises a closure element that is configured for tightening the glove onto the wearer's wrist to prevent dislodgment of the glove during use.

13. The glove of claim 1 further comprising small pores or openings on back sides of the finger portions near tips of respective finger portions.

14. A football glove that is configured to provide heat to a wearer's hand, comprising:

a body member configured for covering the wearer's hand, the body member including palm, finger, thumb, knuckle, wrist and back side portions, wherein the thumb and finger portions are configured to fully cover the wearer's fingers and include at least an index finger portion and a pinky finger portion, with the body member having an opening on the back side portion;

a pocket provided beneath the back side portion of the body member, the pocket extending from the knuckle portion to the wrist portion and being accessible through the back side portion opening, wherein the pocket is configured and dimensioned to cover the wearer's knuckles and to extend toward the wrist portion and is securely attached to the glove to avoid movement in the glove during use;

a heating element comprising a pouch that encloses a heat generating material that is configured to be activated by contact with air, wherein the heating element is configured to conform to and provide heat to the back of the wearer's hand and includes two side wings, one of which is configured to extend to a side portion of the body member between the palm and the back side portion that extends from a bottom of the index finger portion to a bottom of the thumb portion, and the other of which is configured to extend to a side portion of the body member between the palm and the back side portion that extends from a bottom of the pinky finger portion towards the wrist portion, and wherein the heating element is further configured and dimensioned to be of substantially the same size as the pocket such that the heating element after activation is snugly received in and conforms to the pocket in order to be retained therein substantially without movement during use of the glove;

a covering member for closing the opening and retaining the heating element in the pocket during use of the glove, wherein the covering member is selectively removable from a first position where the opening is exposed to allow insertion or removal of the heating element therein or therefrom, to a second position where the covering member closes the opening and is attached or adhered to the glove;

an attachment member associated with the covering member and wrist area of the glove for releasably attaching or adhering the covering member to the glove to retain the heating element in the pocket during use of the glove, a continuous or discontinuous tacky material, coating or layer completely covering the palm portion of the glove including the palm area and the palm side of the thumb and finger portions; and wherein the heating element includes an air activatable composition that includes a mixture of iron powder, charcoal, salt, sawdust, and vermiculite.

15. The glove of claim 14 further comprising a layer between the pocket and an outer surface on the back side of the glove, the layer including a heat reflecting material configured so that the heat emanating from the heating element is directed towards the wearer's hand.

16. The glove of claim 14 wherein the covering member is shaped to conform to the back portion of the glove, and the attachment member is selected from the group consisting of: hook and loop fasteners, snaps, a zipper, and buttons and buttonholes; wherein part of the attachment member is provided on the covering member, and a mating part is provided on the back portion of the glove to allow the covering member to be releasably attached to the back portion of the glove.

17. The glove of claim 14 further comprising small pores or openings on the back sides of the finger portions near tips of respective finger portions.

* * * * *